US009982469B2

(12) United States Patent
Sofianek et al.

(10) Patent No.: US 9,982,469 B2
(45) Date of Patent: May 29, 2018

(54) PIVOT BAR FOR WINDOW SASH

(71) Applicant: Caldwell Manufacturing Company North America, LLC, Rochester, NY (US)

(72) Inventors: Jay Sofianek, Webster, NY (US); John Kessler, Henrietta, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 13 days.

(21) Appl. No.: 14/923,578

(22) Filed: Oct. 27, 2015

(65) Prior Publication Data

US 2016/0123048 A1 May 5, 2016

Related U.S. Application Data

(60) Provisional application No. 62/072,598, filed on Oct. 30, 2014.

(51) Int. Cl.

| | |
|---|---|
| ***E05C 1/10*** | (2006.01) |
| ***E06B 3/50*** | (2006.01) |
| *E05D 15/22* | (2006.01) |
| *E05C 7/00* | (2006.01) |
| *E05D 13/00* | (2006.01) |

(52) U.S. Cl.

CPC ..... *E05C 1/10* (2013.01); *E06B 3/5063* (2013.01); *E05C 2007/007* (2013.01); *E05D 13/1207* (2013.01); *E05D 15/22* (2013.01)

(58) Field of Classification Search

CPC ... E06B 3/5063; E05D 13/12; E05D 13/1207; E05D 13/1276; E05D 15/22

See application file for complete search history.

(56) References Cited

U.S. PATENT DOCUMENTS

| | | | | | |
|---|---|---|---|---|---|
| 4,850,735 | A * | 7/1989 | Hansen | A46B 5/02 | 24/615 |
| 4,926,524 | A * | 5/1990 | Owens | E05D 15/22 | 16/386 |
| 5,139,291 | A | 8/1992 | Schultz | | |
| 5,558,458 | A * | 9/1996 | Silvis | F16B 5/0036 | 403/384 |
| 5,699,601 | A * | 12/1997 | Gilliam | B25B 27/00 | 29/270 |
| 5,927,013 | A * | 7/1999 | Slocomb | E05D 15/22 | 49/176 |
| 6,058,653 | A * | 5/2000 | Slocomb | E05D 15/22 | 49/176 |
| 6,187,404 | B1 * | 2/2001 | Schumann | A47G 1/175 | 248/205.3 |

(Continued)

*Primary Examiner* — Katherine W Mitchell
*Assistant Examiner* — Catherine A Kelly
(74) *Attorney, Agent, or Firm* — Harness, Dickey & Pierce, P.L.C.

(57) ABSTRACT

A pivot bar for a tiltable window sash may include an elongated body, an anti-rotation feature and a retaining finger. The elongated body has first and second opposing ends and first and second opposing surfaces extending between the first and second ends. The elongated body also has a first longitudinal axis extending through the first and second ends. The first end may be configured to be received in a window balance assembly. The retaining finger may extend from the second surface and may be configured to engage the tiltable window sash.

11 Claims, 7 Drawing Sheets

(56) References Cited

U.S. PATENT DOCUMENTS

| | | | | |
|---|---|---|---|---|
| 6,230,443 | B1 * | 5/2001 | Schultz | E05D 15/22 49/181 |
| 6,393,661 | B1 * | 5/2002 | Braid | E05D 13/1276 16/193 |
| 6,606,761 | B2 * | 8/2003 | Braid | E05D 13/1276 16/193 |
| 6,612,078 | B2 * | 9/2003 | Hawang | A47B 47/042 403/353 |
| 6,769,727 | B2 * | 8/2004 | Delavalle | B62D 25/163 293/120 |
| 6,857,228 | B2 * | 2/2005 | Kunz | E05D 13/08 16/197 |
| 7,073,292 | B1 * | 7/2006 | Minter | E05B 65/0876 160/381 |
| 8,814,112 | B2 * | 8/2014 | Thompson | A47G 1/175 248/205.3 |
| 8,979,054 | B2 * | 3/2015 | Thompson | A47K 5/02 248/220.21 |
| 9,097,061 | B1 * | 8/2015 | Lawrence | E06B 3/5063 |
| 2005/0193630 | A1 * | 9/2005 | Marshik | E05C 1/10 49/181 |

* cited by examiner

PIVOT BAR FOR WINDOW SASH

CROSS-REFERENCE TO RELATED APPLICATIONS

This application claims the benefit of U.S. Provisional Application No. 62/072,598, filed on Oct. 30, 2014. The entire disclosure of the above application is incorporated herein by reference.

FIELD

The present disclosure relates to hardware for a window sash, and more particularly, to a pivot bar for a tiltable window sash.

BACKGROUND

This section provides background information related to the present disclosure and is not necessarily prior art.

Modern window assemblies in residential, commercial and industrial buildings may include one or more window sashes that are vertically moveable relative to a window jamb. The window sash(es) may include pivot bars, allowing the window sash(es) to also tilt relative to a window jamb.

SUMMARY

This section provides a general summary of the disclosure, and is not a comprehensive disclosure of its full scope or all of its features.

In one form, the present disclosure provides a pivot bar for a tiltable window sash that may include an elongated body, an anti-rotation feature and a retaining finger. The elongated body has first and second opposing ends and first and second opposing surfaces extending between the first and second ends. The elongated body also has a first longitudinal axis extending through the first and second ends. The first end may be configured to be received in a window balance assembly. The retaining finger may extend from the second surface and may be configured to engage the tiltable window sash.

In some embodiments, the retaining finger is resiliently flexible relative to the elongated body and includes a fixed end and a free end.

In some embodiments, the retaining finger includes a first leg and a second leg, the first leg extends laterally outward from the second surface of the elongated body and the second leg extends from a distal end of the first leg.

In some embodiments, a free end of the second leg includes a retaining prong extending toward the elongated body.

In some embodiments, the second leg includes a second longitudinal axis that is substantially parallel to the first longitudinal axis.

In some embodiments, the first leg includes a third longitudinal axis that is substantially perpendicular to the first and second longitudinal axes.

In some embodiments, a fourth longitudinal axis of the anti-rotation feature and the third longitudinal axis of the first leg of the retaining finger are collinear.

In some embodiments, a fourth longitudinal axis of the anti-rotation feature is parallel to the third longitudinal axis of the first leg of the retaining finger.

In some embodiments, the first leg includes a first length extending along the third longitudinal axis and the second leg includes a second length extending along the second longitudinal axis, the first length is different than the second length.

In some embodiments, the anti-rotation feature includes a second longitudinal axis that is perpendicular to the first longitudinal axis of the elongated body.

In some embodiments, the pivot bar further comprises a second retaining finger extending from the second surface of the elongated body and is configured to engage the tiltable window sash.

In some embodiments, the second retaining finger includes a third leg and a fourth leg. The third leg extends laterally outward from the second surface of the elongated body and the fourth leg extends from a distal end of the third leg. The fourth leg includes a length that is different than the second leg and the third leg.

In yet another form, the present disclosure provides a window assembly that may include a window sash and a pivot bar. The window sash includes a vertical portion connected to a horizontal portion. The vertical portion includes a first aperture. The pivot bar includes an elongated body having first and second opposing surfaces and first and second opposing ends. The pivot bar may include a first retaining member extending from the second surface and received through the first aperture of the vertical portion. The first retaining member attaches the pivot bar to the window sash such that the first end extends laterally outward from the vertical portion of the window sash.

In some embodiments, the window assembly further comprises a window balance assembly engaging the first end of the pivot bar and supporting the window sash for rotation about an axis defined by the pivot bar.

In some embodiments, the horizontal portion includes a second aperture into which a tip of the first retaining member is received and a third aperture through which a portion of the elongated body is received.

In some embodiments, the horizontal portion includes a fourth aperture, and the pivot bar includes a second retaining member extending from the second surface. The second retaining member includes a second barb received in the fourth aperture.

In some embodiments, the first and second retaining members are resiliently flexible relative to the elongated body and each include a fixed end and a free end, the first and second barbs are disposed on the free ends of the first and second retaining members.

In some embodiments, the pivot bar includes a tab extending from the first surface and engaging the vertical portion of the window sash.

In some embodiments, the elongated body includes an anti-rotation feature engaging the vertical portion of the window sash.

In some embodiments, the tab extends from the first surface of the elongated body along a first longitudinal axis, the first retaining member includes a first leg extending from the second surface of the elongated body along a second longitudinal axis, and the second retaining member includes a second leg extending from the second surface of the elongated body along a third longitudinal axis, the first longitudinal axis and one of the second longitudinal axis and the third longitudinal axis are collinear.

In some embodiments, the anti-rotation feature extends from the first surface of the elongated body along a first longitudinal axis; the first retaining member includes a first leg extending from the second surface of the elongated body along a second longitudinal axis. The second retaining member includes a second leg extending from the second surface of the elongated body along a third longitudinal axis. The first longitudinal axis and one of the second longitudinal axis and the third longitudinal axis are coplanar.

In some embodiments, the window sash further includes a second vertical portion connected to the horizontal portion, the horizontal portion further includes fifth and sixth apertures, the window assembly further includes a second pivot bar including a third retaining member received through the fifth aperture of the window sash, the third retaining member includes a third barb received in the sixth aperture of the window sash securely attaching the second pivot bar to the window sash.

In some embodiments, the second pivot bar includes a second tab and a fourth retaining member, the second tab engaging the second vertical portion of the window sash, the fourth retaining member received through a seventh aperture of the window sash, the fourth retaining member including a fourth barb received in an eighth aperture of the window sash.

In yet another form, the present disclosure provides a window assembly comprising a window sash a first pivot bar and a second pivot bar. The window sash includes first and second opposing vertical portions extending from respective first and second opposing ends of a horizontal portion. The first vertical portion has a first aperture and the horizontal portion has second, third, and fourth apertures. The second vertical portion has a fifth aperture. The horizontal portion further has sixth, seventh, and eighth apertures. The first pivot bar is attached to the window sash and extends laterally outward from the first aperture in a first direction. The first pivot bar includes a first elongated body, first and second retaining members extending from the first elongated body and a first projection extending from the first elongated body. The first retaining member includes a first barb received in the second aperture of the horizontal portion of the window sash. The second retaining member is received in the third aperture of the horizontal portion and includes a second barb received in the fourth aperture of the horizontal portion. The first projection abuts the first vertical portion of the window frame. The second pivot bar is attached to the window sash and extends laterally outward from the fifth aperture in a second direction opposite the first direction. The second pivot bar includes a second elongated body, third and fourth retaining members extending from the second elongated body and a second projection extending from the second elongated body. The third retaining member includes a third barb received in the sixth aperture of the horizontal portion. The fourth retaining member is received through the seventh aperture of the horizontal portion and includes a fourth barb received in the eighth aperture of the horizontal portion. The second projection abuts the second vertical portion of the window frame.

In some embodiments, the first retaining member includes a first leg and a second leg. The first leg extends laterally outward from a first surface of the first elongated body and the second leg extends from a distal end of the first leg. The second retaining member includes a third leg and a fourth leg. The third leg extends laterally outward from the first surface of the first elongated body and the fourth leg extends from a distal end of the third leg. The second leg and the fourth leg extend along a common axis, and the projection extends laterally outward from a second surface of the first elongated body.

In some embodiments, the window assembly further comprises first and second opposing window jambs. The first window jamb has a first jamb channel including a first window balance assembly. The first elongated body of the first pivot bar has a first end configured to engage the first window balance assembly. The second window jamb has a second jamb channel including a second window balance assembly. The second elongated body of the second pivot bar has a second end configured to engage the second window balance assembly.

In yet another form, the present disclosure provides a window assembly comprising a window sash and a first pivot bar. The window sash includes a first vertical portion and a horizontal portion. The first vertical portion defines a first aperture. The first pivot bar has an elongate body extending between opposing first and second ends and includes a first projection extending from the elongated body. The first end of the pivot bar is configured to be received in the first aperture such that the first projection engages at least a portion of the first vertical portion and the second end extends at least partially laterally outward from the first vertical portion.

In some embodiments, the first pivot bar further includes a first retaining prong configured to engage an inner surface of the vertical portion.

In some embodiments, the first pivot bar further includes a first retaining prong configured to engage a second aperture defined in the horizontal portion.

In some embodiments, the first pivot bar includes a second retaining prong configured to engage a third aperture defined in the horizontal portion.

In some embodiments, the window sash further includes a second vertical portion defining a fourth aperture and a second pivot bar including a second projection. A third end of the second pivot bar and the second projection of the second pivot bar are configured to be received in the fourth aperture of the second vertical portion such that the second projection engages at least a portion of the second vertical portion and a fourth end of the second pivot bar extends at least partially laterally outward from the second vertical portion.

In some embodiments, the second pivot bar includes a third retaining prong and a fourth retaining prong. The third retaining prong is configured to engage a fifth aperture defined in the horizontal portion. The fourth retaining prong is configured to engage a sixth aperture defined in the horizontal portion when the third retaining prong engages the sixth aperture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
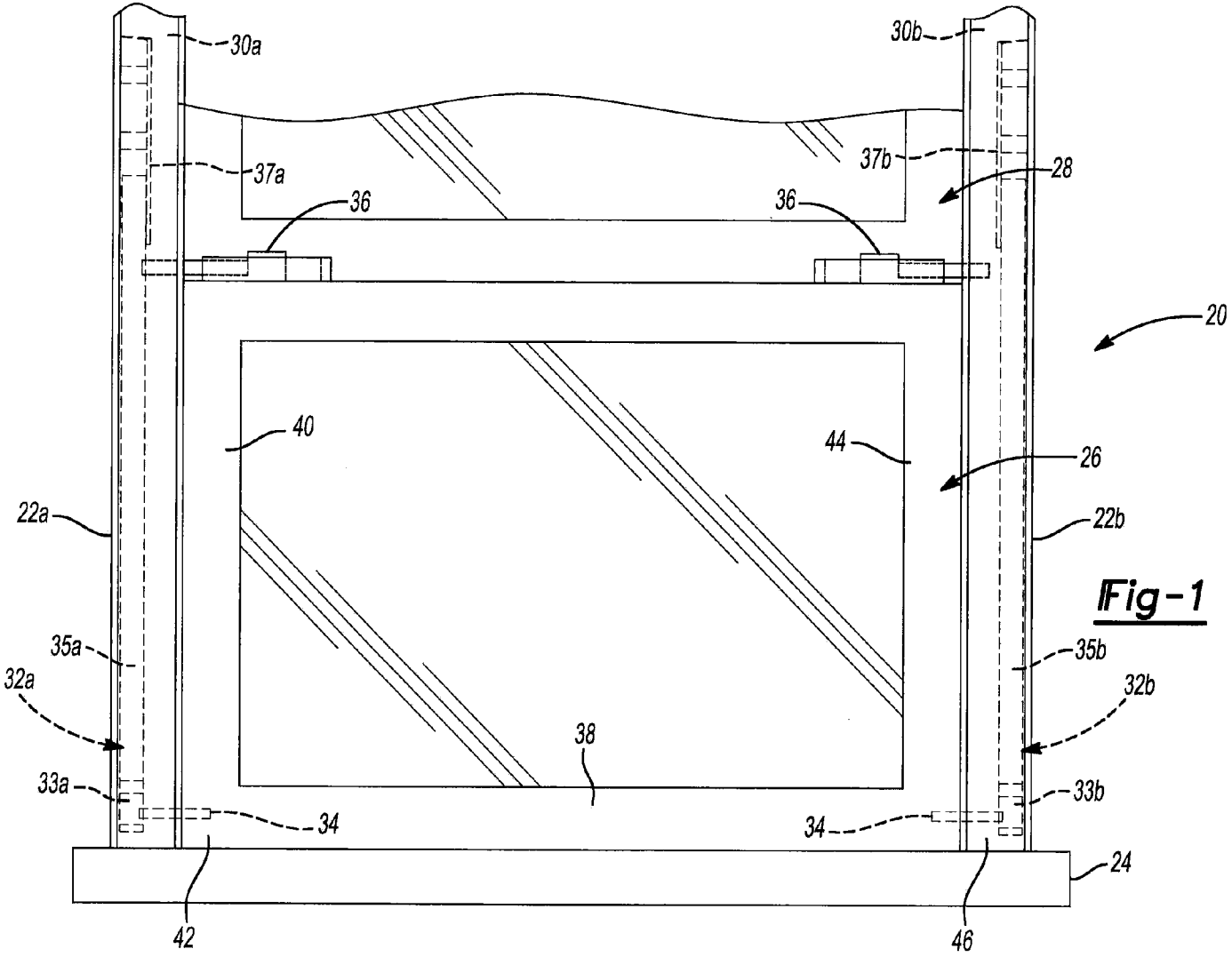
FIG. 1 is a partial front view of a window assembly including a lower sash and a pair of pivot bars according to the principles of the present disclosure.
Figure 2A:
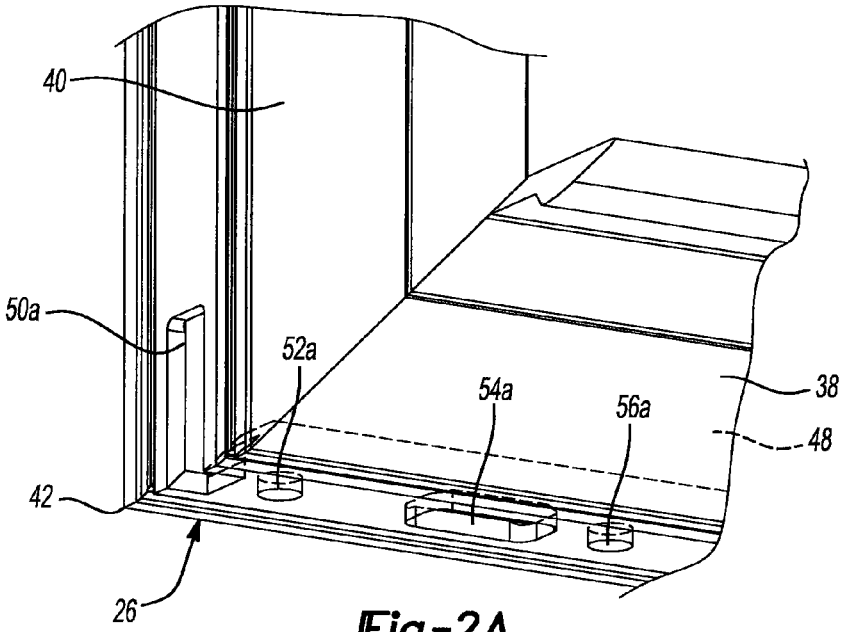
FIGS. 2A and 2B are partial perspective views of the lower sash of FIG. 1.
Figure 2B:
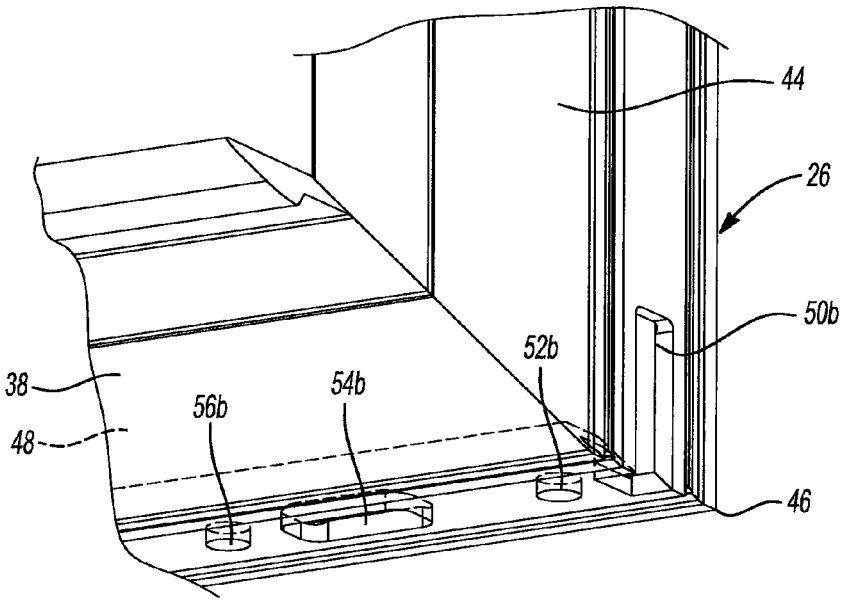
Figure 4:
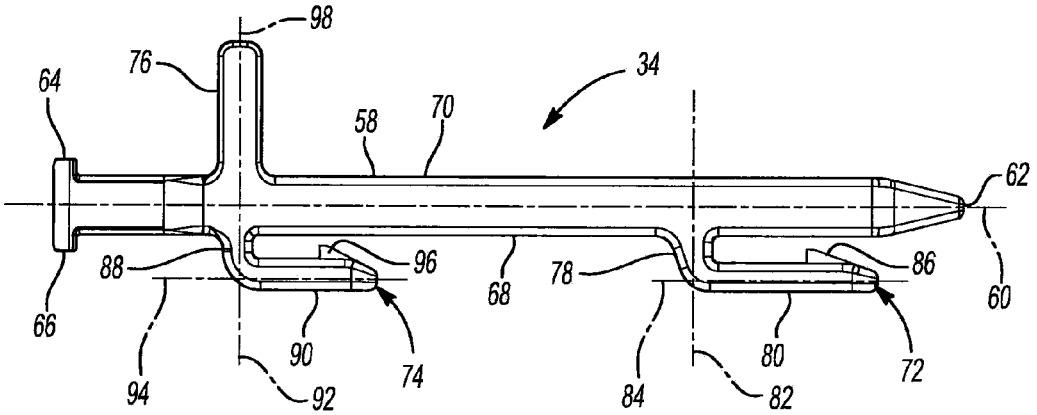
Figure 6:
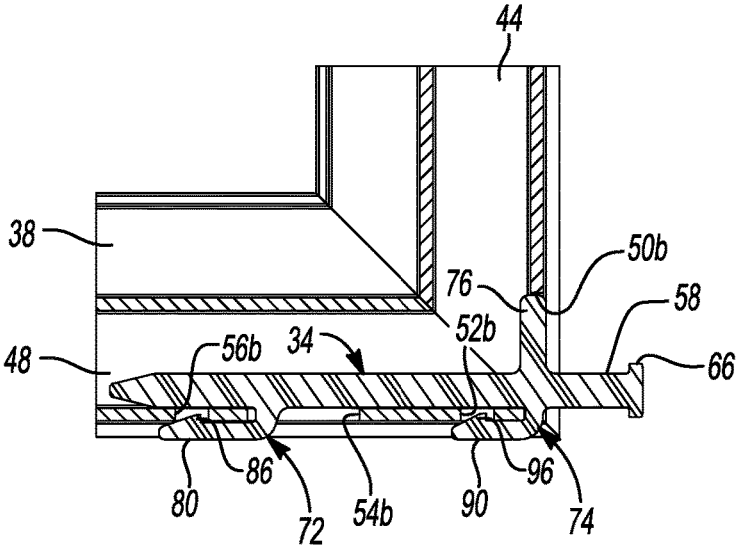
Figure 7:
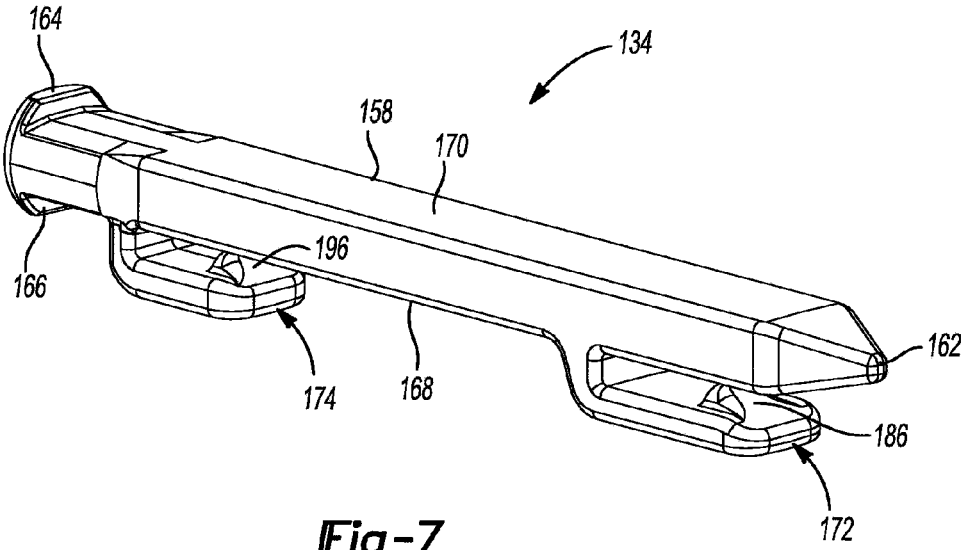
Figure 8:
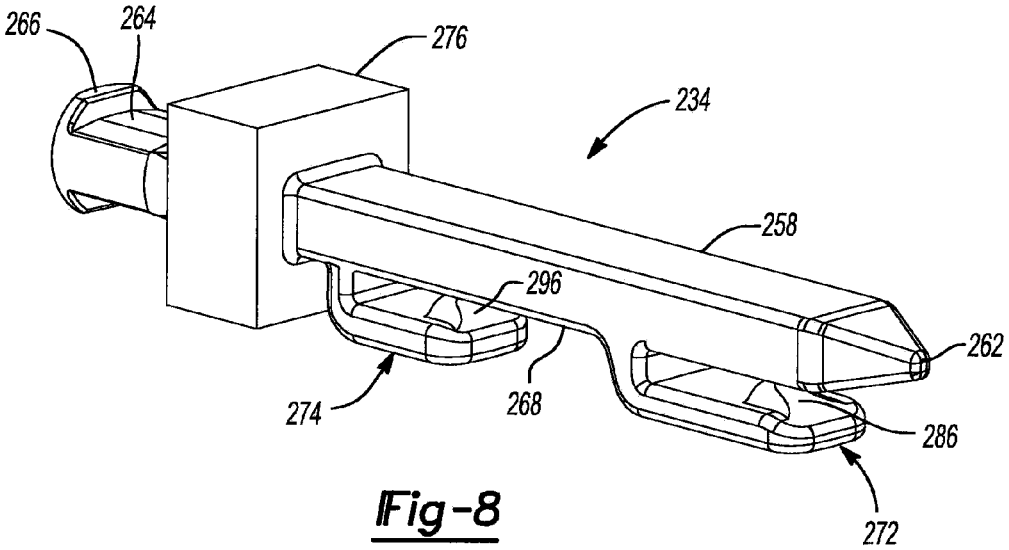
Figure 9:
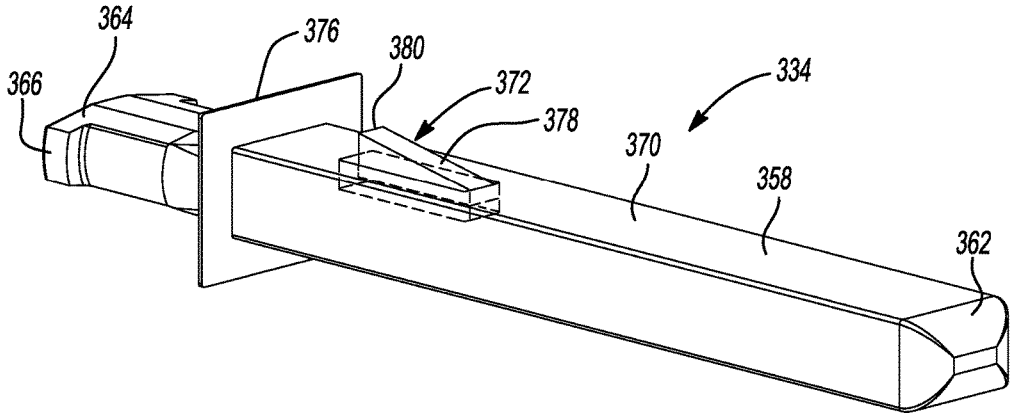
Figure 10:
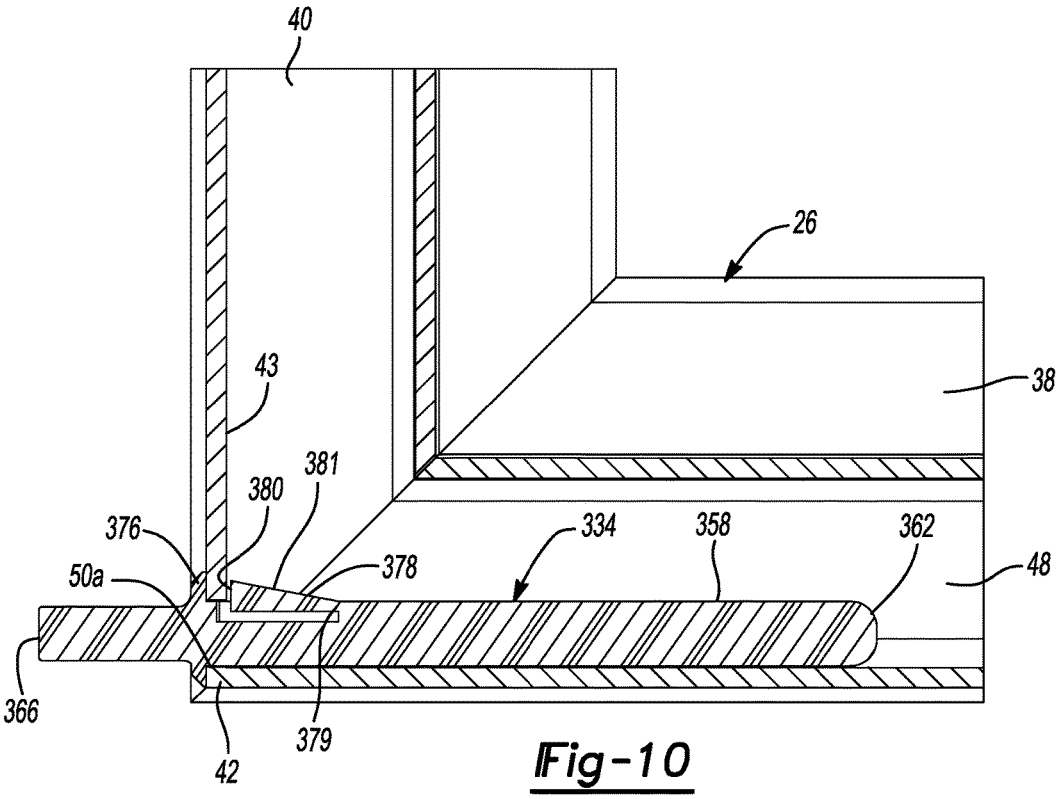

FIG. 4. is a front view of one of the pivot bars of FIG. 1 according to the principles of the present disclosure;

FIGS. 5A-5E are cross-sectional views showing a method of attaching one of the pivot bars to the lower sash of FIG. 2A according to the principles of the present disclosure;

FIG. 6 is a cross-sectional view showing another one of the pivot bars attached to the lower sash of FIG. 2B according to the principles of the present disclosure;

FIG. 7 is a perspective view of another pivot bar according to the principles of the present disclosure;

FIG. 8 is a perspective view of another pivot bar according to the principles of the present disclosure;

FIG. 9 is a perspective view of another pivot bar according to the principles of the present disclosure; and FIG. 10 is a cross-sectional view showing the pivot bar of FIG. 9 attached to the lower sash of FIG. 2A according to the principles of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a window assembly 20 is provided that may include a pair of opposing window jambs 22*a*, 22*b*, a window sill 24, a header (not shown), a lower sash 26 and an upper sash 28. Each window jamb 22*a*, 22*b* may include a jamb channel 30*a*, 30*b* having at least one window balance assembly 32*a*, 32*b*, respectively. Each window balance assembly 32*a*, 32*b* may include a corresponding carrier (or shoe) 33*a*, 33*b*, a corresponding spring 35*a*, 35*b* and a corresponding bracket 37*a*, 37*b*. Each bracket 37*a*, 37*b* may be fixedly attached to a corresponding window jamb 22*a*, 22*b*, and each spring 35*a*, 35*b* may extend between a corresponding bracket 37*a*, 37*b* and a corresponding carrier 33*a*, 33*b* to bias the carriers 33*a*, 33*b* upward. It will be appreciated that the window balance assemblies 32*a*, 32*b* can be configured in any suitable manner. For example, the structure and function of the window balance assemblies 32*a*, 32*b* could be similar or identical to that of any of the window balance assemblies disclosed in Assignee's commonly owned U.S. Pat. No. 8,561,260, U.S. Patent Application Publication No. 2014/0000172, and U.S. Pat. No. 6,041,476, the disclosures of which are hereby incorporated by reference.

The lower sash 26 may include a pair of pivot bars 34 and a pair of tilt latch mechanisms 36. Each pivot bar 34 may be securely attached to a lower portion of the lower sash 26 and may extend horizontally outward in an opposing direction into a corresponding jamb channel 30*a*, 30*b* and selectively engage a corresponding carrier 33*a*, 33*b*. When engaged, the window balance assemblies 32*a*, 32*b* may assist a user in raising and lowering the lower sash 26 between an open and closed position, respectively and to maintain the lower sash 26 at a desired vertical position relative to the window jambs 22*a*, 22*b*, for example.

Each tilt latch mechanism 36 may be securely attached to an upper portion of the lower sash 26 and may extend horizontally outward in an opposing direction and selectively engage a corresponding window jamb 22*a*, 22*b*. The tilt latch mechanisms 36 may be selectively actuated (i.e., retracted from the window jambs 22*a*, 22*b*) to allow the lower sash 26 to pivot about the pivot bars 34 relative to the window jambs 22*a*, 22*b* to facilitate cleaning of an exterior side of the window assembly 20 and to allow separation of the lower sash 26 from the window assembly 20, for example.

In the particular embodiment illustrated in FIG. 1, the upper sash 28 is fixed relative to the window jambs 22*a*, 22*b* (i.e., a single hung window assembly); however, in some embodiments, the upper sash 28 may also be movable relative to the window jambs 22*a*, 22*b* (i.e., a double hung window assembly). It will be appreciated that in a double hung window assembly, the upper sash 28 may also be connected to two or more window balance assemblies to assist the user in raising and lowering the upper sash 28 between an open and closed position, respectively and to maintain the upper sash 28 at a desired vertical position relative to the window jambs 22*a*, 22*b*, for example. In such a window assembly, the upper sash 28 may also include tilt latch mechanisms and pivot bars to allow the upper sash 28 to function in the manner described above.

With additional reference to FIGS. 2A and 2B, the lower sash 26 may comprise a frame and include a lower horizontal portion or rail 38 and opposing first and second vertical portions or stiles 40, 44 connected to the lower horizontal portion 38 at respective first and second corners 42, 46. A channel 48 may extend through at least a portion of the lower horizontal portion 38 and at least a portion of each of the first and second vertical portions 40, 44. At the first corner 42 (FIG. 2A), an aperture 50*a* in communication with the channel 48 may extend through the lower horizontal portion 38 and the first vertical portion 40. At the second corner 46 (FIG. 2B), a similar aperture 50*b* also in communication with the channel 48 may extend through the lower horizontal portion 38 and the second vertical portion 44. Near the first corner 42, a first set of second 52*a*, third 54*a* and fourth apertures 56*a* in communication with the channel 48 may extend through the lower horizontal portion 38 (FIG. 2A), and near the second corner 46, a second set of similar second 52*b*, third 54*b* and fourth apertures 56*b* in communication with the channel 48 may also extend through the lower horizontal portion 38 (FIG. 2B).

Figure 3:
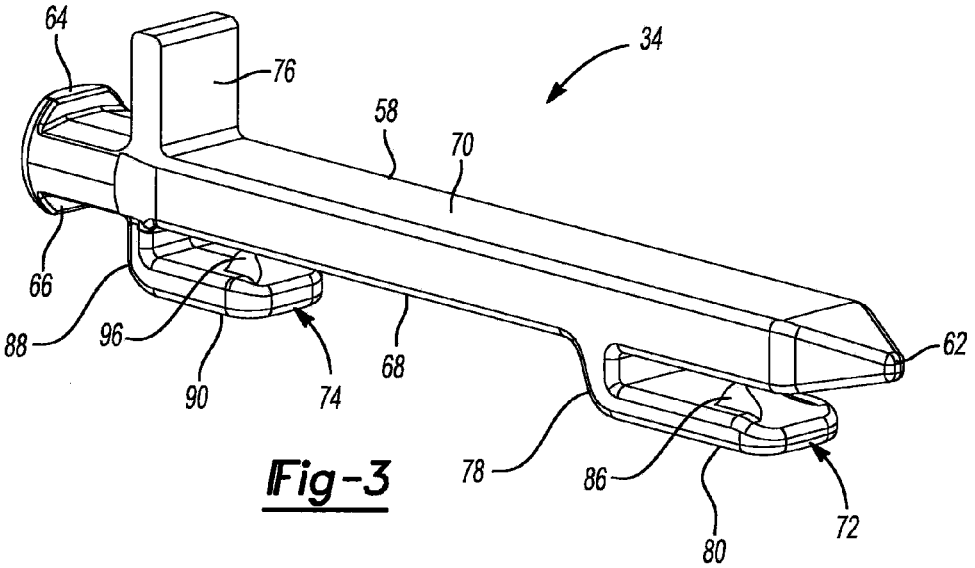
FIG. 3 is a perspective view of one of the pivot bars of FIG. 1 according to the principles of the present disclosure.

With reference to FIGS. 3 and 4, the pivot bars 34 may each include an elongated body 58 molded and/or machined from a polymeric or metallic material, for example. The elongated body 58 may have a rectangular shape extending along a first longitudinal axis 60 and may include first and second opposing ends 62, 64. The first end 62 may be tapered, and the second end 64 may include a flange 66 for selectively engaging one of the carriers 33*a*, 33*b* of a corresponding window balance assembly 32*a*, 32*b*. First and second retaining members 72, 74 may extend from a lower surface 68 of the elongated body 58, and an anti-rotation feature 76 may extend from an opposing upper surface 70. As will be described further below, the first and second retaining members 72, 74 and the anti-rotation feature 76 may cooperate to securely attach the pivot bar 34 to the lower sash 26.

The first retaining member 72 may be integrally formed with the elongated body 58 or may be attached thereto. The first retaining member 72 may include a resiliently flexible first leg 78 extending downwardly from the lower surface 68 of the elongated body 58 along a second longitudinal axis 82, and a resiliently flexible second leg 80 extending horizontally from a distal end of the first leg 78 along a third longitudinal axis 84. The second longitudinal axis 82 of the first leg 78 may be substantially perpendicular to the first longitudinal axis 60 of the elongated body 58, and the third longitudinal axis 84 of the second leg 80 may be substantially parallel to the first longitudinal axis 60 of the elongated body 58 A first retaining prong or barb 86 may be disposed near a distal end of the second leg 80 and may extend upwardly towards the lower surface 68 of the elongated body 58. As shown, the first leg 78 is generally shorter in length than the second leg 80; however in other configurations, the first leg 78 may be the same length or longer than the second leg 80.

The second retaining member 74 may also be integrally formed with the elongated body 58 or may be rigidly attached thereto. The second retaining member 74 may include a resiliently flexible third leg 88 extending downwardly from the lower surface 68 of the elongated body 58 along a fourth longitudinal axis 92. A resiliently flexible fourth leg 90 extending horizontally from a distal end of the third leg 88 along a fifth longitudinal axis 94. A second retaining prong or barb 96 may be disposed near a distal end of the fourth leg 90 and may extend upwardly towards the lower surface 68 of the elongated body 58. As shown, the third leg 88 is generally shorter in length than the fourth leg 90; however, in some configurations, the third leg 88 may be the same length or longer in length than the fourth leg 90. Also, the third leg 88 may be the same length as the first leg 78 of the first retaining member 72, or the third leg 88 may be shorter or longer in length than the first leg 78. Similarly, the fourth leg 90 may be the same length, shorter, or longer than the second leg 80 of the first retaining member 72. The fourth longitudinal axis 92 of the third leg 88 may be substantially perpendicular to the first longitudinal axis 60 of the elongated body 58, and the fifth longitudinal axis 94 of the fourth leg 90 may be substantially parallel to the first longitudinal axis 60 of the elongated body 58. The fifth longitudinal axis 94 of the fourth leg 90 may also be collinear with the third longitudinal axis 84 of the second leg 80.

The anti-rotation feature 76 may be a rectangular projection extending upwardly from the upper surface 70 of the elongated body 58 along a sixth longitudinal axis 98. The anti-rotation feature 76 may be configured to engage the lower sash 26, as will be described further below. Alternatively, the anti-rotation feature 76 may include other shapes and/or cross sections. The sixth longitudinal axis 98 of the anti-rotation feature 76 may be substantially perpendicular to the first longitudinal axis 60 of the elongated body 58, the third longitudinal axis 84 of the second leg 80 and the fifth longitudinal axis 94 of the fourth leg 90. The sixth longitudinal axis 98 of the anti-rotation feature 76 may also be substantially parallel to the second longitudinal axis 82 of the first leg 78 and the fourth longitudinal axis 92 of the third leg 88, and may further be collinear with the fourth longitudinal axis 92 of the third leg 88.

With reference to FIGS. 5A-5E and 6, a method of attaching the pivot bars 34 to the lower sash 26 will be described. The same description may also apply to attaching one or more pivot bars to an upper sash of a double hung window assembly.

Figure 5A:
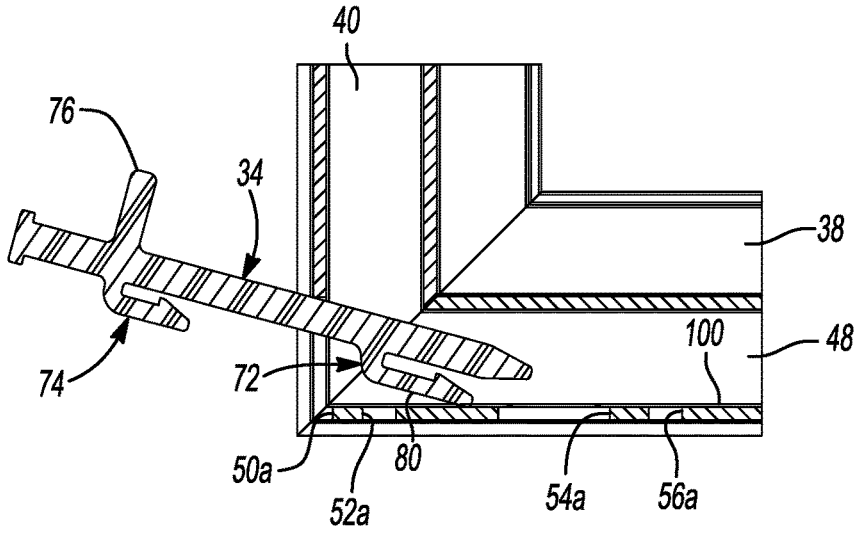
Figure 5B:
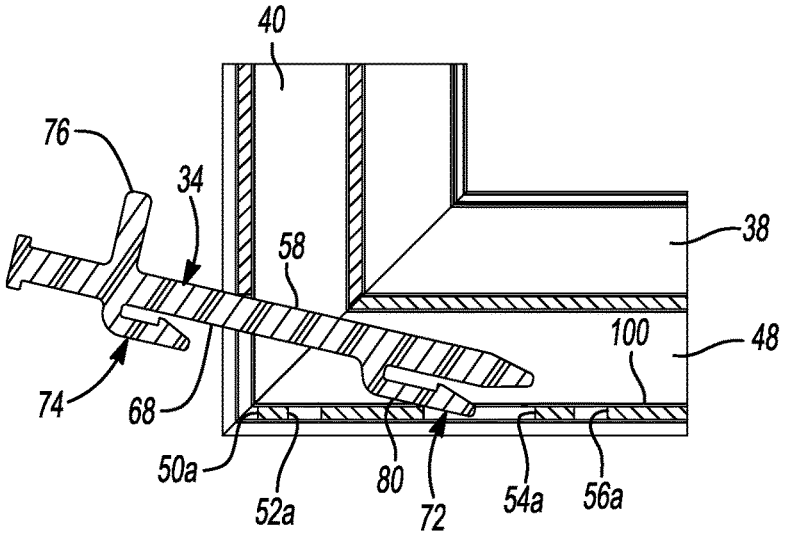
Figure 5C:
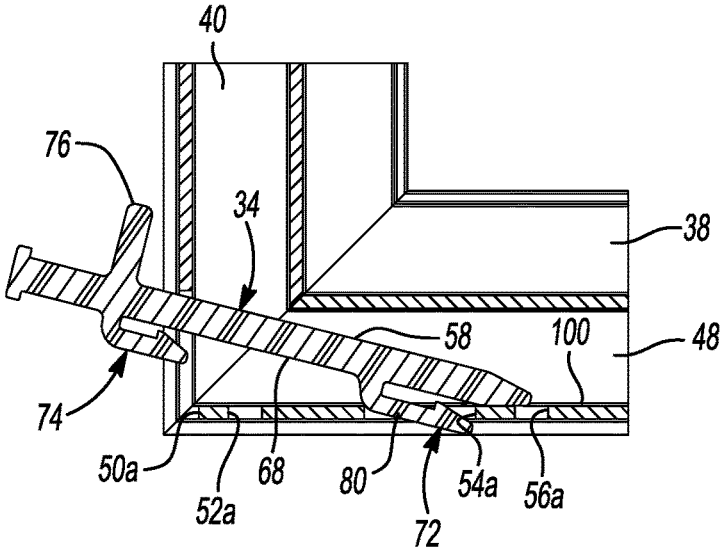
Figure 5D:
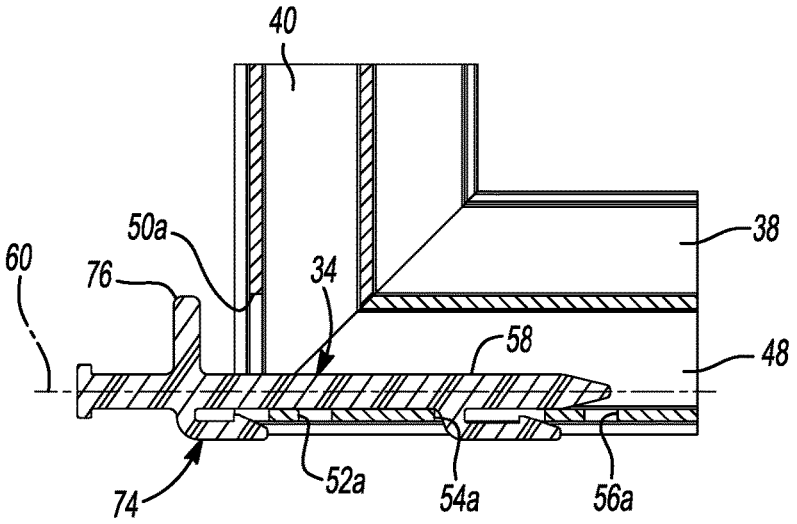
Figure 5E:
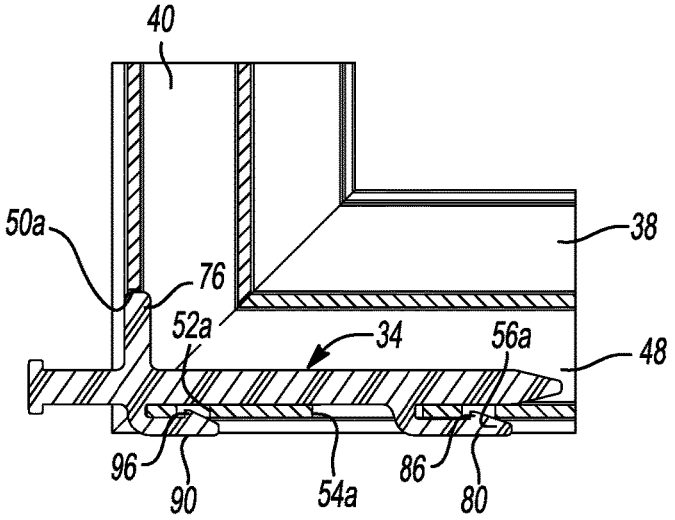

At FIGS. 5A-5C, one of the pivot bars 34 may be angularly inserted into the aperture 50*a* and into the channel 48 of the lower sash 26 until the second leg 80 of the first retaining member 72 is received through the third aperture 54*a* of the horizontal portion 38. At FIG. 5D, the pivot bar 34 may be tilted downwardly such that the first longitudinal axis 60 of the elongated body 58 is oriented generally parallel to the horizontal portion 38. At FIG. 5E, the pivot bar 34 may be horizontally inserted further into the channel 48 until the anti-rotation feature 76 engages the first vertical portion 40, the first retaining barb 86 snaps into the fourth aperture 56*a*, and the second retaining barb 96 snaps into the second aperture 52*a*. Alternatively, the pivot bar 34 may be horizontally inserted into the channel 48 until the anti-rotation feature 76 is partially received in the aperture 50*a* and the first and second retaining barbs 86, 96 snap into the fourth and second apertures 56*a*, 52*a*, respectively. Accordingly, the pivot bar 34 can be securely attached to the lower sash 26 without requiring any fasteners or mounting hardware as may be required in other applications to securely attach a pivot bar to a lower sash. In this regard, the number of components required to construct a lower sash may be reduced. Additionally, by not requiring any fasteners or mounting hardware to securely attach a pivot bar to a lower sash, the time and cost required to assemble a lower sash may be reduced, as ancillary equipment required to install fasteners and/or mounting hardware is not required, for example. Further, the quality and consistency of attaching a pivot bar to a lower sash may be improved, as the need to calibrate and periodically verify screw torque settings is eliminated, for example.

As shown in FIG. 6, the pivot bar 34 may be securely attached to the other side of the lower sash 26 in a similar manner described above. That is, the pivot bar 34 may be angularly, and subsequently horizontally, inserted into the aperture 50*b* and into the channel 48 of the lower sash 26 until the anti-rotation feature 76 engages the second vertical portion 44, the first retaining barb 86 of the first retaining member 72 snaps into the fourth aperture 56*b* of the horizontal portion 38, and the second retaining barb 96 of the second retaining member 74 snaps into the second aperture 52*b* of the horizontal portion 38.

Once the pivot bars 34 are attached to the lower sash 26, the lower sash 26 may be positioned between the opposing window jambs 22*a*, 22*b*, as shown in FIG. 1, and the flange 66 of each pivot bar 34 may selectively engage the corresponding carrier 33*a*, 33*b* of a corresponding window balance assembly 32*a*, 32*b*. The tilt latch mechanisms 36 may then be selectively actuated (i.e., retracted from the window jambs 22*a*, 22*b*) to allow the lower sash 26 to pivot about the pivot bars 34 relative to the window jambs 22*a*, 22*b*. It will be appreciated that when each pivot bar 34 is securely attached to the lower sash 26, and the anti-rotation feature 76 engages a respective first and second vertical portion 40, 44 of the lower sash 26, each anti-rotation feature 76 may act as a torque-arrestor to brace the pivot bar 34 against reaction forces generated from torque or twisting forces applied on the pivot bar 34 and/or on the retaining members 72, 74 as the lower sash 26 pivots about the pivot bars 34 relative to the window jambs 22*a*, 22*b*.

The pivot bar(s) 34 may be removed from the lower sash 26 by generally following the previously described attachment method in reverse. In other words, with reference to FIGS. 5E and 6, with the lower sash 26 separated from the window jambs 22*a*, 22*b*, each of the second and fourth legs 80, 90 of the retaining members 72, 74 may be flexed downwardly and away from the horizontal portion 38 of the lower sash 26 until each of the retaining barbs 86, 96 snap out of the corresponding and respective apertures 56*a*, 52*a* and 56*b*, 52*b* of the horizontal portion 38. Each of the pivot bars 34 may then be removed from the channel 48 and from the respective apertures 50*a*, 50*b*.

With reference to FIG. 7, another pivot bar 134 for use with the lower sash 26 of the window assembly 20 of FIG. 1 is shown. Like the pivot bar 34 described above, the pivot bar 134 may include an elongated body 158 having a rectangular shape molded and/or machined from a polymeric or metallic material, for example. The elongated body 158 may include a first tapering end 162 and an opposing second end 164. The second end 164 may include a flange 166 configured to selectively engage the carrier 33*a*, 33*b* of a corresponding window balance assembly 32*a*, 32*b* of FIG. 1.

The elongated body 158 may also include first and second retaining members 172, 174 that may be similar to the first and second retaining members 72, 74 described above. For example, each of the first and second retaining members 172, 174 may extend downwardly from a lower surface 168 of the elongated body 158. Each retaining member 172, 174 may include a respective retaining prong or barb 186, 196 configured to selectively snap into a corresponding aperture defined in the lower sash 26. However, unlike the pivot bar 34, the pivot bar 134 may lack an anti-rotation feature like the above-described anti-rotation feature 76 for example.

Because the method for attaching one or more pivot bars 134 to the lower sash 26 may be similar to the method for attaching one or more pivot bars 34 to the lower sash 26 described above (save for an anti-rotation feature engaging one of the vertical portions 40, 44 of the lower sash 26), and because the method for removing one or more pivot bars 134 from the lower sash 26 may be similar to the method for removing one or more pivot bars 34 from the lower sash 26 described above, neither will be described in detail herein.

With reference to FIG. 8, another pivot bar 234 for use with the lower sash 26 of the window assembly 20 of FIG. 1 is shown. The pivot bar 234 may be generally similar to the pivot bar 34 described above, apart from any exceptions described herein and/or shown in the figures. The pivot bar 234 may include an elongated body 258 having a rectangular shape molded and/or machined from a polymeric or metallic material. The elongated body 258 may include a first tapered end 262 and an opposing second end 264. The second end 264 may include a flange 266 configured to selectively engage the carrier 33*a*, 33*b* of a corresponding window balance assembly 32*a*, 32*b* of FIG. 1. The elongated body 258 may also include first and second retaining members 272, 274 that may be similar to the first and second retaining members 72, 74 of the pivot bar 34. For example, each of the first and second retaining members 272, 274 may extend downwardly from a lower surface 268 of the elongated body 258, and each retaining member 272, 274 may include a respective retaining prong or barb 286, 296 configured to selectively snap into a corresponding aperture defined in the lower sash 26.

The elongated body 258 may further include a torque arrestor or anti-rotation feature 276 disposed between the second retaining member 274 and the flange 266. The anti-rotation feature 276 may be configured to engage at least a portion of the lower sash 26, such as one of the first and second vertical portions 40, 44 for example. The anti-rotation feature 276 may act to brace the pivot bar 234 against reaction forces generated from torque or twisting forces applied onto the pivot bar 234 and/or the retaining members 272, 274 as the lower sash 26 pivots about the pivot bars 234. The anti-rotation feature 276 may have a rectangular-prism shape centered on longitudinal axis of the elongated body 258. That is, the anti-rotation feature 276 may extend outward from the elongated body 258 in an upward direction, in a downward direction and in two opposing lateral directions. It should be understood that in some configurations, the anti-rotation feature 276 may include other shapes and/or cross sections configured to engage at least a portion of the lower sash 26 to brace the pivot bar 234 against reaction forces during use.

The method for attaching one or more of the pivot bars 234 to the lower sash 26 may be similar to the above-described method for attaching one or more of the pivot bars 34 to the lower sash 26 and will therefore not be described again in detail. Also, the method for removing one or more of the pivot bars 234 from the lower sash 26 may be similar to the above-described method for removing one or more of the pivot bars 34 from the lower sash 26 described above and will therefore also not be described again in detail.

With reference to FIGS. 9 and 10, another pivot bar 334 for use with the lower sash 26 of the window assembly 20 of FIG. 1 is shown. The pivot bar 334 may include an elongated body 358 having a substantially rectangular shape molded and/or machined from a polymeric or metallic material, for example. The elongated body 358 may have a first tapered end 362 and an opposing second end 364. The opposing second end 364 may include a flange 366 configured to selectively engage the carrier 33*a*, 33*b* of a corresponding window balance assembly 32*a*, 32*b* of FIG. 1.

The elongated body 358 may also include a first retaining member 372 having a resilient hinge portion 379 and a resiliently flexible leg 378 including a ramp surface 381. The first retaining member 372 is configured to be biased or flexed into an unlocked position. In other words, the leg 378 may be biased or flexed and/or pivotable about the hinge portion 379 from a locked position (shown in FIG. 9) downwardly such that a tip 380 of the leg 378 and/or the ramp surface 381 may be approximately co-planar with an upper surface 370 of the elongated body 358. In some configurations, the elongated body 358 may include additional retaining members (not shown) that could be similar to either of the retaining members 72, 372, for example.

An anti-rotation feature 376 may be disposed between the flange 366 and the first retaining member 372. Once the pivot bar 334 is attached to the lower sash 26, the anti-rotation feature 376 may engage at least a portion of the lower sash 26 and brace the pivot bar 334 against torque or twisting forces applied on the pivot bar 334 and/or on the retaining member 372 as the lower sash 26 pivots about the pivot bars 334. It should be understood, however, while the anti-rotation feature 376 resembles a collar or plate shape in FIG. 9, other shapes and/or cross sections configured to engage at least a portion of the lower sash 26 may be used. For example, the anti-rotation feature 376 could be configured similarly to either of the anti-rotation features 76, 276.

At FIG. 10, the pivot bar 334 is shown attached to the lower sash 26. It should be understood that while other apertures are not shown in the lower horizontal portion 38 and the first vertical portion 40 (like in FIG. 2A, for example), other apertures may be included in the lower horizontal portion 38 and the first vertical portions 40.

To attach the pivot bar 334 to the lower sash 26, the tapered end 362 of the elongated body 358 may be inserted into the aperture 50*a*. The aperture 50*a* may be sized to allow the elongated body 358 to snugly fit therethrough with the leg 378 in the unlocked position. The pivot bar 334 may be pushed horizontally through the aperture 50*a* into the channel 48. As the pivot bar 334 is advanced into the aperture 50*a*, an interference between the ramp surface 381 and the aperture 50*a* forces the leg 378 to pivot downwardly about the hinge portion 379 until the ramp surface 381 and the tip 380 of the leg 378 become approximately co-planar with the upper surface 370 of the pivot bar 334 and can thereby pass through the aperture 50*a*. Once the pivot bar 334 is advanced to a point that the tip 380 passes through the aperture 50*a*, the leg 378 pivots upwardly about the hinge portion 379 in a "spring back" action. As such, the tip 380 of the leg 378 engages an inner surface 43 of the vertical portion 40 and the anti-rotation feature 376 engages at least an outer surface of the first vertical portion 40 as shown in FIG. 10. Accordingly, the pivot bar 334 can be securely attached to the lower sash 26 without requiring any fasteners or mounting hardware. The same description may also apply to attaching the pivot bar 334 to the other side of the lower sash 26 and/or to attaching one or more pivot bars 334 to an upper sash of a double hung window assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pivot bar for a tiltable window sash comprising:

an elongated body having first and second opposing ends and upper and lower opposing surfaces extending between the first and second ends, the elongated body having a first longitudinal axis extending through the first and second ends about which the tiltable window sash is tiltable, the first end of the elongated body configured to be received in a carrier of a window balance assembly;

a retaining member extending upward from the upper surface of the elongated body that is resiliently flexible relative to the elongated body and comprises a first fixed end and a first free end; and an anti-rotation feature comprising a projection extending outward from the elongated body substantially perpendicular to the first longitudinal axis;

wherein the first fixed end of the retaining member comprises a hinge portion connecting the retaining member to the elongated body;

wherein the first free end of the retaining member comprises a ramp surface inclined from the first fixed end outwardly from the upper surface of the elongated body and toward the first end;

wherein the ramp surface is pivotable about the hinge portion to a position such that the ramp surface is substantially coplanar with the upper surface of the elongated body;

wherein the anti-rotation feature is disposed intermediate the first end of the elongated body and the retaining member and engages an aperture in a vertical stile of the window sash to prevent rotation of the pivot bar;

wherein a distal tip of the first free end is configured to engage the vertical stile of the window sash; and wherein the anti-rotation feature and the retaining member are configured to cooperably engage the tiltable window sash and securely attach the pivot bar thereto.

2. A pivot bar for a tiltable window sash comprising:

an elongated body having first and second opposing ends and upper and lower opposing surfaces extending between the first and second ends, the elongated body having a first longitudinal axis extending through the first and second ends about which the tiltable window sash is tiltable, the first end of the elongated body configured to be received in a carrier of a window balance assembly;

a first retaining member resiliently flexible relative to the elongated body and extending outward from the lower surface of the elongated body, the first retaining member comprising a first leg extending from the lower surface of the body along a second longitudinal axis that is substantially perpendicular to the first longitudinal axis and a second leg extending from a first distal end of the first leg along a third longitudinal axis that is substantially parallel to the first longitudinal axis, the second leg having a first retaining prong protruding toward the lower surface of the elongated body; and an anti-rotation feature comprising a fourth longitudinal axis that is perpendicular to the first longitudinal axis and substantially collinear with the second longitudinal axis and a projection extending from at least one of the upper surface and the lower surface of the elongated body in a first direction substantially perpendicular to the upper surface or the lower surface;

wherein the anti-rotation feature is configured to engage a first surface of the window sash in a second direction perpendicular to the first longitudinal axis and the first direction; and wherein the anti-rotation feature and the first retaining member are configured to cooperably engage the tiltable window sash and securely attach the pivot bar to the tiltable window sash.

3. The pivot bar of claim 2, further comprising a second retaining member extending from the lower surface of the elongated body and offset from the first retaining member along the first longitudinal axis; and wherein the anti-rotation feature, the first retaining member, and the second retaining member are configured to cooperably engage the window sash and securely attach the pivot bar to the window sash.

4. The pivot bar of claim 3, wherein the second retaining member is resiliently flexible relative to the elongated body;

wherein the second leg of the first retaining member has a second length along the third longitudinal axis;

wherein the second retaining member comprises a third leg along a fifth longitudinal axis and a fourth leg extending from a distal end of the third leg and having a fourth length along the third longitudinal axis and a second retaining prong protruding toward the lower surface of the elongated body;

wherein the fourth length is greater than the second length.

5. A tiltable window sash comprising the pivot bar of claim 4.

6. A tiltable window sash comprising the pivot bar of claim 2.

7. A tiltable window sash comprising:

a frame comprising an upper end and a lower end, a first vertical stile, a horizontal rail and a second vertical stile, the first and second vertical stiles connected to opposite ends of the horizontal rail at the lower end of the frame;

wherein the first vertical stile comprises a first aperture, the second vertical stile comprises a second aperture and the horizontal rail comprises a third aperture adjacent to the first aperture and a fourth aperture adjacent to the second aperture;

a first pivot bar attached to the frame at the first vertical stile and the horizontal rail and a second pivot bar attached to the frame at the second vertical stile and the horizontal rail, each pivot bar comprising:

an elongated body having first and second opposing ends and upper and lower opposing surfaces extending between the first and second ends, the elongated body having a first longitudinal axis extending through the first and second ends about which the tiltable window sash is tiltable, the first end of the elongated body configured to be received in a carrier of a window balance assembly;

a retaining member resiliently flexible relative to the elongated body and extending outward from the lower surface of the elongated body, the first retaining member comprising a first leg extending from the lower surface of the body along a second longitudinal axis that is substantially perpendicular to the first longitudinal axis and a second leg extending from a distal end of the first leg along a third longitudinal axis that is substantially parallel to the first longitudinal axis, the second leg having a retaining prong protruding toward the lower surface of the elongated body;

wherein the retaining prongs of the first and second pivot bars respectively engage the third and fourth apertures of the horizontal rail; and an anti-rotation feature comprising a fourth longitudinal axis that is perpendicular to the first longitudinal axis and substantially collinear with the second longitudinal axis and a projection extending from at least one of the upper surface and the lower surface of the elongated body in a first direction substantially perpendicular to the upper surface or the lower surface;

wherein the anti-rotation feature of each of the first and second pivot bars is configured to engage the first and second vertical stiles, respectively, in a second direction perpendicular to the first longitudinal axis and the first direction; and wherein the anti-rotation features and the retaining members are configured to cooperably engage the first and second vertical stiles to securely attach the pivot bars to the frame.

8. The tiltable window sash of claim 7, wherein the first horizontal rail further comprises a fifth aperture and a sixth aperture located near the first vertical stile and a seventh aperture and an eighth aperture located near the second vertical stile;

wherein each of the first pivot bar and second pivot bar further comprises a second retaining member resiliently flexible relative to the elongated body and extending outward from the lower surface of the elongated body, the second retaining member comprising a third leg extending from the lower surface of the body along the second longitudinal axis and a fourth leg extending from a distal end of the third leg along a third longitudinal axis, the fourth leg having a second retaining prong protruding toward the lower surface of the elongated body;

wherein the third legs of the second retaining members of the first and second pivot bars respectively extend through the fifth and seventh apertures and the second retaining prongs respectively engage the sixth and eighth apertures.

9. A window assembly comprising the tiltable window sash of claim 8.

10. The tiltable window sash of claim 8, wherein a length of the second leg of the retaining member is less than a length of the fourth leg of the second retaining member.

11. A window assembly comprising the tiltable window sash of claim 7.

* * * * *